United States Patent [19]

Kimpel et al.

[11] Patent Number: 4,539,540

[45] Date of Patent: Sep. 3, 1985

[54] ELECTROMAGNETIC ROTATING ARMATURE RELAY

[75] Inventors: Rolf-Dieter Kimpel, Unterschweinbach; Heinz Stadler; Alfred Heinzl, both of Munich, all of Fed. Rep. of Germany

[73] Assignee: Siemens Aktiengesellschaft, Berlin & Munich, Fed. Rep. of Germany

[21] Appl. No.: 495,648

[22] Filed: May 18, 1983

[30] Foreign Application Priority Data

Jun. 3, 1982 [DE] Fed. Rep. of Germany ..... 3220985

[51] Int. Cl.[3] ..... H01H 50/58

[52] U.S. Cl. ..... 335/125; 335/78; 335/128

[58] Field of Search ..... 335/78, 79, 80, 81, 335/83, 84, 125, 128

[56] References Cited

U.S. PATENT DOCUMENTS 3,993,971 11/1976 Ono et al. ..... 335/202

4,307,362 12/1981 Kobler et al. ..... 335/202

FOREIGN PATENT DOCUMENTS 2229327 3/1973 Fed. Rep. of Germany ..... 335/128

38-14972 8/1963 Japan ..... 335/78

*Primary Examiner*—E. A. Goldberg

*Assistant Examiner*—George Andrews

*Attorney, Agent, or Firm*—Hill, Van Santen, Steadman & Simpson

[57] ABSTRACT

The rotating armature relay exhibits one or two ferromagnetic bars which are provided with an insulating covering in their central area. Contact springs are secured in the insulation covering, the contacting, free ends of said contact springs respectively interacting with cooperating contact elements anchored in a base body. As a result, a slide-free and, thus, low-friction actuation derives as, however, does relatively high friction at the contact locations, whereby contact impacts are suppressed and foreign layers are abraded from the contact surfaces.

9 Claims, 2 Drawing Figures

ELECTROMAGNETIC ROTATING ARMATURE RELAY

BACKGROUND OF THE INVENTION

1. Field of the Invention

The present invention relates to an electromagnetic rotating armature relay with a base body consisting of insulating material and carrying an excitation coil and in which contact terminal elements are anchored and on which an armature is rotatably seated, being approximately centrally seated, whereby the armature exhibits at least one elongated, ferromagnetic bar whose free ends form working air gaps with the pole ends of a coil core and which carries a covering of insulating material in its central area which contains bearing elements.

2. Description of the Prior Art

A rotating armature relay of this type is known, for example, from the German OS No. 27 23 430 (corresponding to U.S. Pat. No. 4,307,362). Depending upon the specific design of the magnetic circuit and of the armature, with or without permanent magnets, this relay can function non-polarized or polarized, monostably or bistably. Such rotating armature relays are generally relatively sensitive given low response power and are also largely insensitive to jolts because of the central armature bearing. Given the known relays of this type, the actuation of the contacts ensues by means of actuation members which are either directly or indirectly connected to the armature and which influence the movable contact springs which are in turn anchored in the base body together with the stationary cooperating contact elements. The friction of the armature in its bearing and, in particular, the friction between the actuation member slide and the movable contact springs can not be overlooked in its effect on the operation of the relay. The actuation members normally consist of insulating material, and the abrasion from the friction between the actuation members and the contact springs can represent a hazard to the contact surfaces.

It would be desirable therefore, to provide a relay mechanism with reduced friction between the movable contact springs and the associated actuation member. Low-voltage relays generally have very low breaking capacity, however, a certain friction at the contact locations is definitely desired in order to damp contact impacts and in order to avoid the occurrence of foreign layers on the contact surfaces. Given heavy current relays, current spike formation is thereby largely prevented given a dc load.

SUMMARY OF THE INVENTION

An object of the invention is to develop a rotating armature relay of the type described above such that the largest possible friction paths arise at the contacts and other frictional losses in the armature movement or, respectively, in the contact actuation are largely avoided and, thus, the excitation power of the relay can be kept small.

Given a relay of the type described above, this object is inventively achieved in that contact springs interacting with cooperating contact elements anchored in the base body are secured in the coating of insulating material of the armature, being respectively secured proceeding parallel to the ferromagnetic bar or bars.

In the inventive relay the movable contact springs are directly connected to the armature such that they proceed laterally next to the ferromagnetic bars forming the actual armature and, thus, also proceed laterally next to the rotational axis of the armature. This means that the center of motion of the movable contact springs does not coincide with their clamping point and a noticeable friction is generated at the contact locations by means of the relative motion thereby arising. During switching the contact springs are damped but no frictional losses due to an actual actuation slide arise since the contact springs are rigidly clamped to the armature.

In an advantageous embodiment of the invention, a respective contact spring is provided at each side of the ferromagnetic bar or bars, the central section of said contact spring being secured in the insulation covering and its two free end sections being respectively engageable in contact with one or two cooperating contacts. In another embodiment, two respective contact springs can be provided at each side of the ferromagnetic bar or bars, the contact springs respectively extending from their fastening location in the insulation covering nearly up to the free end of the armature. In this case, one obtains four movable contact springs insulated from one another which, depending upon the design of the cooperating contact elements on the base body, can form a break contact, a make contact or a changeover contact.

The contact springs secured in the insulation covering of the armature can be connected to terminal elements anchored in the base body, being connected thereto over flexible conductors, i.e., over stranded wires or flexible metal lugs. In another advantageous embodiment it can also be provided that the contact springs secured in the insulation covering of the armature respectively function—without additional connection elements—as contact bridges between two respective cooperating contact elements. In that case, the flexible connection from the base body to the movable armature can be avoided.

The armature which, for example, can be provided with one or more permanent magnets as a so-called H-armature, can be trunnion-mounted to the base body in a known manner, whereby bearing elements, i.e., bearing necks or bearing bores, can be integrated in the insulating covering of the armature. In order to avoid the bearing friction, however, the armature can also be held to the base body over resiliently deformable bearing elements. It is thereby particularly advantageous when projections are integrated onto the contact springs secured in the insulation covering and are anchored to the base body as bearing elements for the armature. The contact springs can thereby be respectively designed of one piece with the bearing elements of the armature and the terminal pins anchored in the base body. The relay can thereby be manufactured with particularly few parts.

BRIEF DESCRIPTION OF THE DRAWINGS

The invention is explained in greater detail below on the basis of sample embodiments and with reference to the drawings in which.

DESCRIPTION OF THE PREFERRED EMBODIMENTS

Figure 1:
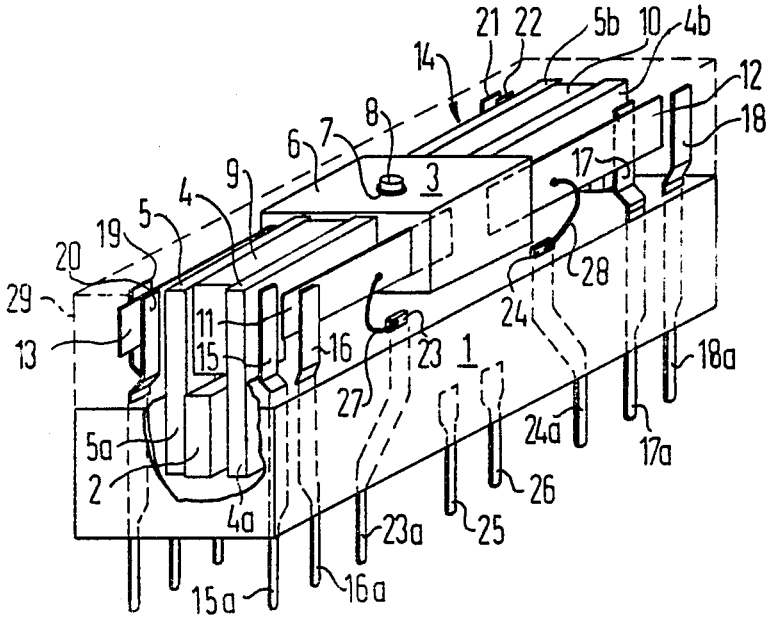
FIG. 1 illustrates a polarized rotating armature relay with trunnion bearing.

FIG. 1 shows a relay with a base body 1 which, for example, can exhibit the shape of a trough open toward the bottom. A coil (not visible) is accommodated in the base body 1, the free ends of its bar-shaped core 2 respectively forming working air gaps with an armature 3 seated on the base body.

The armature 3 consists of two elongated, ferromagnetic bars 4 and 5 whose ends 4*a*, 4*b* and 5*a* and 5*b* extend down and enclose a respective free end of the core 2 with their free ends. The ferromagnetic bars or yokes 4 and 5 are held together by an insulation covering 6. A bearing bore 7 is provided in the insulation covering 6, the armature 3 being rotatably seated on a neck 8 of the base body 1 by means of the bearing bore 7. Two permanent magnets 9 and 10, by means of which the relay experiences a polarization, are disposed between ferromagnetic bars or yokes 4 and 5.

Two respective contact springs 11 and 12 as well as 13 and 14 (not visible) are embedded or secured in some other manner in the insulating covering 6 of the armature 3 adjacent lateral sides thereof, said contact springs being caused to move with every armature movement and accordingly, providing selective contact with cooperating contact elements 15, 16, 17, 18, 19, 20, 21 and 22 anchored in the base body 1. Each of the cooperating contact elements is provided with a corresponding terminal pin 15*a*, 16*a*, etc. at the underside of the base body 1. Connection elements 23 and 24 having corresponding terminal pins 23*a* and 24*a* for the movable contact springs 11 and 12 as well as corresponding connection elements (not visible) for the contact springs 13 and 14 are also anchored in the base body 1. Further terminal pins 25 and 26 are provided for the coil winding. The movable contact springs 11 and 12 are connected to their connection elements 23 or, respectively, 24, over flexible, stranded wires 27 and 28. However, an embodiment would also be conceivable wherein the contact springs 11 and 12 anchored in the insulation covering 6 serve as bridge contact elements without their own terminals and, for example, respectively connect two cooperating contact elements to each other in each switch position, for example, the contact elements 15 and 18 in one switch position as well as the contact elements 16 and 17 in the other switch position. In this case the contact springs 11 and 12 in the insulation covering would be designed as a single, one-piece part.

Upon actuation of the armature 3, the contact springs 11, 12, 13 and 14 connected to it are respectively moved around the rotational axis proceeding through the neck 8, whereby their contacting ends execute not only a circular motion around their clamping point at the insulated covering 6 but, also, execute a circular motion around the rotational axis of the armature 3. Relatively high friction thereby derives at the contact locations, contact impacts thereby being avoided and foreign layers which may potentially occur being thereby rubbed off of the contact surfaces. No friction occurs at an actuation member as occurs in the prior art devices. Since these actuation members normally consist of insulating material, such abrasion always represents a hazard to the contact surfaces which, thus, is avoided here. As a result of the fixed clamping of all movable contact springs in the armature, a restraint also derives, i.e., when one contact is fused, all other contacts remain unalterably closed due to the rigid coupling.

The relay according to FIG. 1 can, for example, be closed by a cap 29 merely suggested in phantom in the Figure. Such a cap 29 can be tightly connected, bonded or welded to the base body 1 in a known manner.

Figure 2:
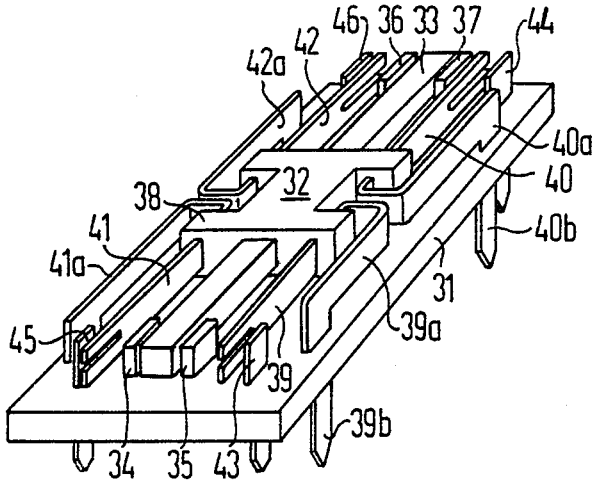
FIG. 2 illustrates an armature seated on a base body over springs.

In a schematic illustration, FIG. 2 shows a modified embodiment of the inventive rotating armature relay. An armature 32 with an elongated, ferromagnetic bar 33 is disposed on a base body 31, the two ends of said bar 33 form working air gaps relative to core pole plates 34 and 35, as well as 36 and 37, disposed in pairs. These are part of a magnet system (not illustrated in further detail) having two U-shaped core elements which carry a coil and enclose a permanent magnet between them. Such a magnet system is disclosed, for example, in the German patent application No. P 31 40 226.7.

In its central part, the armature 32 exhibits an insulation covering 38 in which respective, movable contact springs 39, 40, 41 and 42 are secured by means of plugging or embedding. These movable contact springs interact, for example, with cooperating contact elements 43, 44, 45 and 46 anchored in the base body 31, whereby, of course, changeover contacts can be formed with further cooperating contact elements which are not illustrated.

In the sample embodiment according to FIG. 2, however, the armature is not trunnion-mounted but, rather, is spring-mounted on extension 39*a*, 40*a*, 41*a* and 42*a* of the contact springs 39, 40, 41 and 42. These extensions 39*a*, 40*a*, 41*a* and 42*a* are anchored in the base body 31 and simultaneously form cointegrated terminal pins 39*b*, 40*b*, etc. for the movable contact springs. These extensions can also be designed meander-shaped in order to enable better mobility of the armature. A friction-free armature bearing combined with the advantages of the first sample embodiment thereby ensues.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An electromagnetic rotating armature relay with a base body consisting of insulating material carrying an exciting coil, terminal elements being anchored in said base body and an armature being rotatably seated approximately centrally thereon, whereby the armature includes at least one elongated, ferromagnetic bar with opposed lateral sides whose free end forms working air gaps with a spaced pair of pole ends of a coil core and an insulation covering encasing the central area of the armature which contains bearing elements, characterized in that contact springs interacting with cooperating contact elements anchored in the base body are secured in the insulation covering of the armature, said contact springs respectively proceeding parallel to the ferromagnetic bar.

2. The relay according to claim 1, characterized in that at least one of said contact springs is provided at each side of the ferromagnetic bar, the center sections of said contact springs being secured in the insulation covering and their two free ends being selectively engageable in respective contact to at least one cooperating contact element.

3. An electromagnetic rotating armature relay with a base body consisting of insulating material carrying an exciting coil, terminal elements being anchored in said base body and an armature being rotatably seated approximately centrally thereon, whereby the armature includes at least one elongated, ferromagnetic bar with opposed lateral sides whose free end forms working air gaps with a spaced pair of pole ends of a coil core and which carries an insulation covering in its central area which contains bearing elements, characterized in that contact springs interacting with cooperating contact elements anchored in the base body are secured in the insulation covering of the armature, two of said contact springs being provided at each side of the ferromagnetic bar, said contact springs respectively proceeding parallel to the ferromagnetic bar, and extending from their fastening point in the insulation covering nearly up to the free end of the armature.

4. The relay according to claim 1, characterized in that the contact springs secured in the insulation covering of the armature are connected over respective flexible conductors to connection elements anchored in the base body.

5. The relay according to claim 1, characterized in that the contact springs secured in the insulation covering of the armature serve, without their own respective connection elements, as contact bridges between two respective cooperating contact elements.

6. An electromagnetic rotating armature relay with a base body consisting of insulating material carrying an exciting coil, terminal elements being anchored in said base body and an armature being rotatably seated approximately centrally thereon, whereby the armature includes at least one elongated, ferromagnetic bar with opposed lateral sides whose free end forms working air gaps with a spaced pair of pole ends of a coil core and which carries an insulation covering in its central area which contains bearing elements, characterized in that contact springs interacting with cooperating contact elements anchored in the base body are secured in the insulation covering of the armature, the armature being trunnion-mounted to the base body by means of bearing elements provided at the insulation covering said contact springs respectively proceeding parallel to the ferromagnetic bar.

7. An electromagnetic rotating armature relay with a base body consisting of insulating material carrying an exciting coil, terminal elements being anchored in said base body and an armature being rotatably seated approximately centrally thereon, whereby the armature includes at least one elongated, ferromagnetic bar with opposed lateral sides whose free end forms working air gaps with a spaced pair of pole ends of a coil core and which carries an insulation covering in its central area which contains bearing elements, characterized in that contact springs interacting with cooperating contact elements anchored in the base body are secured in the insulation covering of the armature, the armature being held on the base body over resiliently deformable bearing elements, said contact springs respectively proceeding parallel to the ferromagnetic bar.

8. The relay according to claim 7, characterized in that extensions of the contact springs are secured in the insulation covering, said extensions being anchored in the base body as said bearing elements for the armature.

9. The relay according to claim 8, characterized in that the contact springs are respectively designed of one piece with the bearing elements and the terminal elements anchored in the base body.

* * * * *